United States Patent [19]

Gravemann

[11] Patent Number: 5,069,270

[45] Date of Patent: Dec. 3, 1991

[54] CONTINUOUS CASTING MOLD

[75] Inventor: Horst Gravemann, Osnabrueck, Fed. Rep. of Germany

[73] Assignee: KM-Kabel Metall AG, Osnabrueck, Fed. Rep. of Germany

[21] Appl. No.: 365,909

[22] Filed: Jun. 14, 1989

[30] Foreign Application Priority Data

Jun. 14, 1988 [DE] Fed. Rep. of Germany ..... 3820203

[51] Int. Cl.[5] ..... B22D 11/06

[52] U.S. Cl. ..... 164/481; 164/138; 164/418; 164/431

[58] Field of Search ..... 164/418, 430, 431, 459, 164/481, 138

[56] References Cited

U.S. PATENT DOCUMENTS

| | | | |
|---|---|---|---|
| 4,155,396 | 5/1979 | Dompas et al. | 164/431 |
| 4,589,930 | 5/1986 | Kumagai | 164/418 |

FOREIGN PATENT DOCUMENTS

| | | | |
|---|---|---|---|
| 2634614 | 2/1978 | Fed. Rep. of Germany . | |
| 128351 | 10/1980 | Japan | 164/418 |
| 212839 | 12/1983 | Japan | 164/418 |
| 1106737 | 5/1986 | Japan | 164/418 |
| 1153246 | 7/1986 | Japan | 164/418 |
| 2099339 | 12/1982 | United Kingdom | 164/430 |

*Primary Examiner*—Richard K. Seidel

*Attorney, Agent, or Firm*—R. H. Siegemund

[57] ABSTRACT

Continuous casting is improved by providing a continuous casting mold of copper alloy, said copper alloy including from 1.6 to 2.4% nickel, from 0.5 to 0.8% silicon, from 0.01 to 0.2% zirconium possibly including up to 0.4% chromium and/or up to 0.2% iron, the remainder copper as well as inevitable manufacturing impurities and usual working additives preferably the zirconium amount is smaller than the upper stated limit and the alloy includes in addition up to 0.1% of at least one of the following cerium, hafnium, niobium, titanium and vanadium.

9 Claims, No Drawings

CONTINUOUS CASTING MOLD

BACKGROUND OF THE INVENTION

The present invention relates to the utilization of age-hardenible copper alloy for the manufacture of sideblocks or dam blocks in twin belt casting machines wherein the molten material solidifies within a gap formed in between two parallel guided belts, strips, ribbons or the like and the blocks prevent lateral outflow. Casting machines of the type to which the invention pertains and more particularly dam blocks or barriers are shown e.g. in U.S. Pat. No. 3,865,176 disclosing a twin belt or strip casting device and including metal blocks which are placed on an endless belt made of steel. These blocks are moved synchronously with the casting belts in longitudinal direction. As stated, the metal dam blocks bound the casting cavity established by the two casting strips.

The throughput of a twin belt or twin strip casting machine clearly depends decisively on the flawless functioning of many parts, including particularly the dam blocks and the chain formed by the plural blocks in this fashion. Specifically it is required that these blocks have a very high thermal conductivity in order to remove the melting and solidification heat as rapidly as possibly. In order to avoid premature wear of the side edges of the dam blocks through mechanical wear it is necessary to use a material which not only is very hard and has high tensile strength, but is also provided with a very low grain structure. It has to be observed that gaps between these blocks must be avoided since the molten material could then penetrate into such gaps. Another important aspect is fatigue; it must be made sure that following departure of the blocks from the line of casting a thermal tension shock is introduced in the blocks when cooling down or return. This shock must not cause them to crack e.g. in the edges and here particularly in the T-grooves in which they guide the steel strip. If such a thermal shock does produce cracks then very soon the particular block will simply drop out of the chain and the molten metal can escape in an uncontrolled fashion and cause havoc in the equipment at large. On the other hand it is clear that as soon as some kind of damage is detected the entire machine has to be stopped, and the casting has to be interrupted and the necessary repairs be carried out.

For testing the propensity towards the formation of cracks a method has been practiced with advantage according to which the blocks are treated for two hours at 500 degrees C and quenched in water of 25 degrees C. This is repeated and these plural thermal shocks must not produce any cracks whatsoever particularly in the zones of the T-grooves.

The material for such dam blocks thus is suggested in the U.S. Pat. No. 3,955,615 is an age hardenible copper alloy which includes form 1.5 to 2.5% nickel, from 0.4 to 0.9% silicon, from 0.1 to 0.5% chromium and from 0.1 to 0.3% iron, all percentages by weight; the remainder of course being copper. Such an alloy is used generally for equipment of the kind referred to above. However, it was found that copper alloys of this type when used specifically for making these dam blocks cause, after a relatively short operating time, the casting device to exhibit fatigue cracks particularly in the critical area of the T-grooves. Aside from a rather unsatisfactory behaviour during thermal shock testing this particular alloy has about 45% IACS which is a relatively low electrical conductivity, and, therefore, it has a relatively low thermal conductivity.

It has been proposed to make dam blocks of copper alloy that includes beryllium. Aside from certain technical advantages such an alloy might have it was found that working with this kind of material is outright dangerous to the health of the people who e.g. will finish in some form or another the blocks and come in intimate contact with that beryllium containing material.

DESCRIPTION OF THE INVENTION

It is an object of the present invention to provide a new and improved material for making continuous casting molds generally which can take up thermal shocks without formation of cracks when having in addition a rather high hot strength.

It is another object of the invention to improve continuous twin belt casting by using a particular material for mold parts.

It is a further object of the invention to provide a new and improved beltlike mold for continuous casting with emphasis on dam blocks for that mold.

In accordance with the preferred embodiment of the present invention it is suggested to use an age hardenible and age hardened copper alloy which has from 1.6 to 2.4% nickel, form 0.5 to 0.8% silicon, from 0.01 to 0.2% zirconium, the remainder copper as well as manufacturing conditioned impurities and other commonly used working additives. This alloy is to be used for components within a casting machine particularly for mold parts subjected to a permanent but alternating high temperature and including particularly dam blocks in twin strip or belt continuous casting machines.

For purposes of increasing the thermal conductivity it is proposed specifically to provide from up to 0.4% chromium. Particularly for reducing grain growth during solution annealling it is suggested to provide some iron as an additive at not more than 0.2%. These additives are of particular advantage for the stated reason. The specific use of zirconium mentioned above is to render the material particularly insensitive towards formation of cracks. The adding of chromium and iron for the stated reason will not act as an offsetting factor for this crack impediment which of course is the primary objective of the invention. Deoxidation components such as boron, lithium, magnesium, or phosphorus up to not more than 0.03% by weight and other normal impurities attributable to manufacture and making were found not to have a negative influence on the formation of cracks. Particularly these components do not increase the propensity towards the formation of cracks of the particular alloy of this invention.

It should be noted that the German printed patent application 26 34 614 proposes an age hardenible copper/nickel/silicon/zirconium alloy with a particular composition of from 1 to 5% nickel, from 0.3 to 1.5% silicon, from 0.05 to 0.35% zirconium, the remainder being copper. This known alloy is proposed for the manufacture of objects which, after hardening have to have a very high ductility at room temperature. This German patent application particularly describes that it is particularly effective zirconium if the material is subjected to cold working from 10 to 40% in between the solution annealling on one hand the age hardening on the other hand. Based on this state of the art it is particularly surprising that the zirconium as per the present invention is effective in a mere hardened state of the copper without cold working, and still just by itself in effect removes thermoshock sensitivity in this kind of copper/nickel/silicon alloy. Supplemental investigations yielded that the hot strength of the inventive alloy, particularly at a temperature of about 500 degrees C. noticeably exceed the hot strength of those materials previously used as dam blocks. It was further found that additional improvements of mechanical properties obtain if some of the zirconium is replaced by up to 0.15% of at least one of the group consisting of cerium, hafnium, niobium, titanium, vanadium.

The invention will be explained more fully with reference to a number of specific examples. Three different alloys in accordance with the invention are identified below as alloys A,B,C; and they are compared with three alloys D,E,F not having the inventive improvement. Here it can be shown how critical the composition of the various instances really is in order to obtain the desired combination of properties. The compositions of course are always stated in % by weight.

TABLE 1

| ALLOY | Ni | Si | Cr | Fe | Zr | Cu |
|---|---|---|---|---|---|---|
| A | 2.12 | 0.70 | | | 0.03 | remainder |
| B | 2.06 | 0.63 | 0.24 | | 0.09 | remainder |
| C | 1.94 | 0.58 | 0.29 | 0.12 | 0.15 | remainder |
| D | 1.82 | 0.63 | | | | remainder |
| E | 1.95 | 0.69 | 0.28 | | | remainder |
| F | 1.87 | 0.72 | 0.38 | 0.12 | | remainder |

The alloys A and D were molten in a vacuum furnace and the other alloys were molten in air in a medium frequency furnace. In each case round blocks were cast with a diameter of 173 mm and these blocks or billets are extruded to obtain square rods in a format of 55×55 mm. Following solution annealling in a temperature between 790 and 810 degrees C. the rods were hardened for four hours at 480 degrees C. The several alloys were tested as to tensile strength Rm at room temperature and Brinell hardness HB (2.5/62.5). The electrical conductivity as well as hot strength Rm at 500 degrees C was ascertained.

Having done all these preliminary investigations dam blocks were made with dimensions of 50×50×40 mm and they were then subjected to thermal shock. Specifically the blocks were held at 500 degrees C for about 2 hours and then quenched in water of 25 degrees C. Whether the block after the thermal shock treatment had cracks or not could actually be ascertained just be visual inspection. In order to make sure a supplemental investigation of the T-grooves of the blocks was carried out under utilization of a microscope with a 10-fold magnification. The extension of any cracks in examples D,E and F always began in the T-grooves and was in the range from 1 to 7 mm. In some cases cracks had a length of about 20 mm. All these test results are summarized in table 2 as follows.

TABLE 2

| ALLOY | $R_m$ (N/mm$^2$) | HB | Conductivity (in % IACS) | $R_m$ (500° C.) (N/mm$^2$) | Behavior after thermo-shock test |
|---|---|---|---|---|---|
| A | 660 | 186 | 41.4 | 286 | crackfree |
| B | 656 | 191 | 42.2 | 372 | crackfree |
| C | 635 | 185 | 43.4 | 335 | crackfree |
| D | 635 | 179 | 34.5 | 219 | presence of cracks |
| E | 653 | 181 | 39.7 | 247 | presence of cracks |
| F | 642 | 184 | 37.2 | 233 | presence of cracks |

The comparison clearly demonstrates that the inventive alloys A,B,C with comparable strength properties at room temperature as well as with particularly electrical and hot strength properties were consistently better as far as the result of thermoshock is concerned, then the reference alloys D,E,F. The inventive alloys are particularly suitable for use in casting molds of the kind described above whereby the blocks are subjected to alternating temperature load throughout casting. This involves particularly the dam blocks mentioned above and as they are used in twin belt or strip casting machines and also as components or used as casting wheels and belts themselves. Also, molds for pressure casting and pressure piston in such casting machines should be made of the inventive alloy.

The invention is not limited to the embodiments described above but all changes and modifications thereof, not constituting departures from the spirit and scope of the invention, are intended to be included.

I claim:

1. A method of continuous casting comprising, providing side blocks for a continuous casting mold of copper alloy, said copper alloy including from 1.6 to 2.4% nickel, from 0.5 to 0.8% silicon, from 0.2 to 0.4% chromium, from 0.01 to 0.2% zirconium, the remainder copper as well as inevitable manufacturing impurities.

2. Method as in claim 1, said copper alloy having from 1.9 to 2.25% nickel, from 0.55 to 0.65% silicon, from 0.2 to 0.3% chromium, from 0.08 to 0.15% zirconium, the remainder impurities.

3. Method as in claim 1, said copper alloy including additionally up to 0.2% iron.

4. Method as in claim 1, said copper alloy having a smaller amount of zirconium than the upper stated limit and including in addition at a total content not exceeding 0.1% of at least one additive selected from the following group, cerium, hafnium, niobium, titanium and vanadium.

5. A continuous casting mold having side blocks made of a copper alloy comprising from 1.6 to 2.4% nickel, from 0.5 to 0.8% silicon, from 0.2 to 0.4% chromium, from 0.101 to 0.2% zirconium, the remainder copper as well as inevitable manufacturing impurities.

6. Mold as in claim 5, said alloy having been annealled at a temperature between 700 and 900 degrees C. followed by quenching and age hardening from ½ hour to 5 hours at a temperature in the range from 350 to 500 degrees C.

7. Mold as in claim 5, said copper alloy consisting essentially from 1.9 to 2.25% nickel, from 0.55 to 0.65% silicon, from 0.2 to 0.3% chromium, from 0.08 to 0.15% zirconium, the remainder being impurities.

8. Mold as in claim 5, said copper alloy including additionally up to 0.2% ion.

9. Mold as in claim 5, said copper alloy having a smaller amount of zirconium than the upper stated limit and including in addition at a total content not exceeding 0.1% of at least one additive selected from the following group, cerium, hafnium, niobium, titanium and vanadium.

* * * * *